US011162178B2

(12) United States Patent
Dulle et al.

(10) Patent No.: US 11,162,178 B2
(45) Date of Patent: Nov. 2, 2021

(54) ELECTRODE FOR ELECTROLYSIS CELLS

(71) Applicant: UHDENORA S.p.A., Milan (IT)

(72) Inventors: Karl-Heinz Dulle, Olfen (DE); Frank Funck, Oberhausen (DE); Dirk Hoormann, Werne a.d. Lippe (DE); Stefan Oelmann, Schwerte-Ergste (DE); Peter Woltering, Neuenkirchen (DE); Carsten Schmitt, Hagen (DE); Philipp Hofmann, Dortmund (DE)

(73) Assignee: UHDENORA S.P.A., Milan (IT)

( * ) Notice: Subject to any disclaimer, the term of this patent is extended or adjusted under 35 U.S.C. 154(b) by 245 days.

(21) Appl. No.: 13/686,971

(22) Filed: Nov. 28, 2012

(65) Prior Publication Data

US 2013/0087465 A1 Apr. 11, 2013

Related U.S. Application Data

(63) Continuation-in-part of application No. PCT/EP2011/002552, filed on May 23, 2011.

(30) Foreign Application Priority Data

May 28, 2010 (DE) ..... 10 2010 021 833.2

(51) Int. Cl.
*C25B 11/03* (2021.01)
*C25B 9/19* (2021.01)

(52) U.S. Cl.
CPC ..... *C25B 11/03* (2013.01); *C25B 9/19* (2021.01)

(58) Field of Classification Search
CPC ..... C25B 11/03; C25B 11/035
See application file for complete search history.

(56) References Cited

U.S. PATENT DOCUMENTS 4,219,400 A 8/1980 Treptow et al.
4,265,719 A * 5/1981 Ezzell ..... C25B 1/46 204/263
4,469,577 A 9/1984 Schmitt et al.
4,627,897 A 12/1986 Tetzlaff et al.
(Continued)

FOREIGN PATENT DOCUMENTS

DE 243256 2/1912
DE 2630883 1/1978
(Continued)

OTHER PUBLICATIONS

International Search Report for PCT/EP2011/002552, English translation attached or original, Both completed by the European Patent Office dated Sep. 8, 2011, All together 5 Pages.

*Primary Examiner* — Brian W Cohen
(74) *Attorney, Agent, or Firm* — Lucas & Mercanti, LLP

(57) ABSTRACT

An electrode of an electrolysis cell for gas-producing electrochemical processes, which includes a plurality of horizontal lamella elements which in the manner of a flat C-profile consist of a flat central part and one or more flank parts, where one or more transition regions of any shape are arranged between the flat central part and the one or more flank parts, where the lamella elements have a plurality of through-openings, where the lamella elements have a flat surface without structural raised regions and depressions and the flat central part has a plurality of through-openings which are arranged in rows and arranged diagonally to one another.

6 Claims, 2 Drawing Sheets

(56) References Cited

U.S. PATENT DOCUMENTS

| | | | | |
|---|---|---|---|---|
| 5,534,122 | A * | 7/1996 | Traini | C25B 11/03 204/266 |
| 5,656,396 | A | 8/1997 | Kimura et al. | |
| 5,660,698 | A | 8/1997 | Scannel et al. | |
| 6,503,377 | B1 | 1/2003 | Borucinski et al. | |
| 7,785,453 | B2 | 8/2010 | Dulle et al. | |
| 2006/0163081 | A1* | 7/2006 | Meneghini et al. | 205/411 |
| 2008/0116081 | A1* | 5/2008 | Dulle et al. | 205/618 |
| 2009/0050472 | A1* | 2/2009 | Federico et al. | 204/252 |

FOREIGN PATENT DOCUMENTS

| | | |
|---|---|---|
| DE | 4415146 | 11/1995 |
| DE | 69600860 | 5/1999 |
| DE | 19816334 | 10/1999 |
| DE | 102005006555 | 8/2006 |
| EP | 0095039 | 11/1983 |
| EP | 0150018 | 7/1985 |

* cited by examiner

ELECTRODE FOR ELECTROLYSIS CELLS

CROSS-REFERENCE TO RELATED APPLICATION

This application is a continuation-in-part of PCT Appln. No. PCT/EP2011/002552 filed on May 23, 2011, which claims priority to German Patent Application No. 10 2010 021 833.2 filed on May 28, 2010, the disclosures of which are incorporated in their entirety by reference herein.

TECHNICAL FIELD

The invention relates to an electrode and a method for gas-producing electrochemical processes, the installed electrode being located in parallel to a face-to-face ion exchange membrane and having a plurality of horizontal lamellar elements, which, in the design of a flat C profile, consist of a flat "belly" section and one or more flank part/s, and one or more transitional section/s of random shape being arranged between the flat belly section and the one or more flank part/s, the lamellar elements being provided with a plurality of through-going holes.

BACKGROUND

The method for gas-producing electrochemical processes is known according to prior art; the same also applies to suitable electrodes which are used in electrolysers. These electrodes are, inter alia, described in DE 198 16 334 A1 owned by the applicant. The said patent describes an electrolyser for the generation of halogen gases from aqueous alkali halide solutions. As the flow conditions during the product gas production in the electrolyte are exposed to detrimental effects in the membrane/electrode zone, DE 198 16 334 A1 suggests to install the individual louvre-type elements in inclined position towards the horizontal level. This method produces a lateral flow in the cell because the gas bubbles that gather under the individual lamellar elements follow the upward stream through the opening provided by this design.

DE 198 16 334 A1, however, does not suggest any solution to the problem, i.e. a defined gas quantity remains underneath the louvre-type elements. Hence, the bubble settling causes a reduction of the electrode contact and a considerable portion of the membrane surface area becomes "blank". The blanking is understood to mean that the fluid cannot flow which prevents gas production in this zone. Moreover, this gas stagnation contributes to the "blanking" and causes a membrane isolation, which inevitably leads to an increase in current density in the other membrane sections so that the cell voltage goes up and the current consumption rises.

In order to eliminate the "blanking" problem, EP 0 095 039 reveals to provide crosswise recesses in the lamellar elements of the electrode. DE 44 15 146 A1, however, states that the said recesses are insufficient to prevent "blanking" DE 44 15 146 A1 consequently suggests to provide holes or bores in the lamellar element part pointing downwards and so to enhance the gas discharge flow. Unsolved in this context is the problem of the residual gas portion that remains in the vicinity of the contact area and thus hinders the electrolyte flow.

This problem is improved by the subject matter in DE 10 2005 006 555 A1 by which such "blanking" effect is minimized. This is achieved by an electrolysis electrode of an electrolysis cell for gas-producing electrochemical processes, the installed electrode being located in parallel to a face-to-face ion exchange membrane and consisting of a plurality of horizontal lamellar elements, which are structured and of three-dimensional design and being in direct contact with the membrane via a surface section of the lamellar element, said lamellar elements having grooves and holes and the majority of the holes being arranged in the grooves, the complete surface areas of such holes or part thereof being located in the grooves or extending into the grooves. By installing electrodes of this kind it was possible to achieve a significant decrease in voltage of more than 50 mV with a current density of 6 kA/m$^2$ as compared to a conventional electrode of similar outer dimensions.

The disadvantage involved is that the grooves generate a surface area that is characterized by constructional elevations and depressions, this being the reason for disadvantageous gas stagnation and, as a consequence, uneven current density distribution across the ion exchange membrane.

The aim of the present invention is to solve this problem. This is to be achieved by providing an electrode which does not involve the aforementioned disadvantages, and a method for the operation of the electrode according to the invention is to achieve a decrease in the cell voltage and a correspondingly reduced electric energy demand.

Surprisingly this aim is achieved by a simplified design of the type described in DE 10 2005 006 555 A1.

SUMMARY

According to the present invention the aim is achieved by using an electrode of an electrolysis cell for gas-producing electrochemical processes. The installed electrode includes a plurality of horizontal lamellar elements, which, in the design of a flat C profile, consist of a flat belly section and one or more flank parts, and one or more transitional sections of random shape being arranged between the flat belly section and the one or more flank parts, the lamellar elements being provided with a plurality of through-going holes and a plane surface area without constructional elevations and depressions, and the flat belly section having a plurality of through-going holes lined up in rows and arranged diagonally to one another.

The present invention differs from a continuous perforated plate as, for example, suggested by DE 69600860 T2, DE 243256 A1 and DE 2630883 A1, as the electrode is composed of a plurality of lamellar elements of three-dimensional design by intentional cold-work elongation. Such bending increases the stability of the electrode and improves the planarity of the surface area which is in contact with the membrane. A combination of single elements of this kind is, as cited at the beginning, the state of the art.

The diagonal arrangement of the holes ensures that the surface of the belly section be exploited to an optimum degree in order to provide as many holes as possible and in this way achieve a further reduction of the gas stagnation. Optionally, the flank parts are also provided with through-going holes.

In a preferred embodiment of the invention the through-going holes are arranged in the contact area of the respective lamellar element with the ion exchange membrane if the electrode has been installed in an electrolysis cell. This arrangement serves the purpose of supplying the ion exchange membrane with electrolyte during operation of the electrolysis cell and to ensure the gas discharge flow.

In a further embodiment of the invention, the through-going holes are punched holes. These holes may be of any optional geometric form, preference being given to holes of round cross-section.

Advantageously, the sheet thickness of the lamellar elements in the case of round through-going holes is smaller than the hole diameter, and/or the sheet thickness of the lamellar elements in the case of non-round through-going holes is smaller than the hydraulic cross-section.

In a particularly advantageous embodiment of the electrode according to the invention, the one or more flank part/s is/are inclined at an angle of at least 10 degrees off the membrane upon installation into an electrolysis cell. The transitional sections are advantageously formed as chamfered edges.

Optionally, the flank parts are also provided with through-going holes.

The spacing between the single horizontally arranged lamellar elements in C profile is preferentially 0 to 5 mm, preferably 0 to 2 mm and particularly preferably 0 mm. By providing as little space as possible between the single lamellar elements, the process is optimised, as approx. 6 to 10% of the membrane surface are recovered and can be used for the actual electrolysis process.

The electrolysis method related to by the present invention is characterised by the use of a plane electrode as described above. For halogen gas production it is of advantage to use electrolysers of the single-cell type or of filter-press design.

BRIEF DESCRIPTION OF THE DRAWINGS

FIG. 1 shows: Top view of a lamellar element according to the invention in C profile design;

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
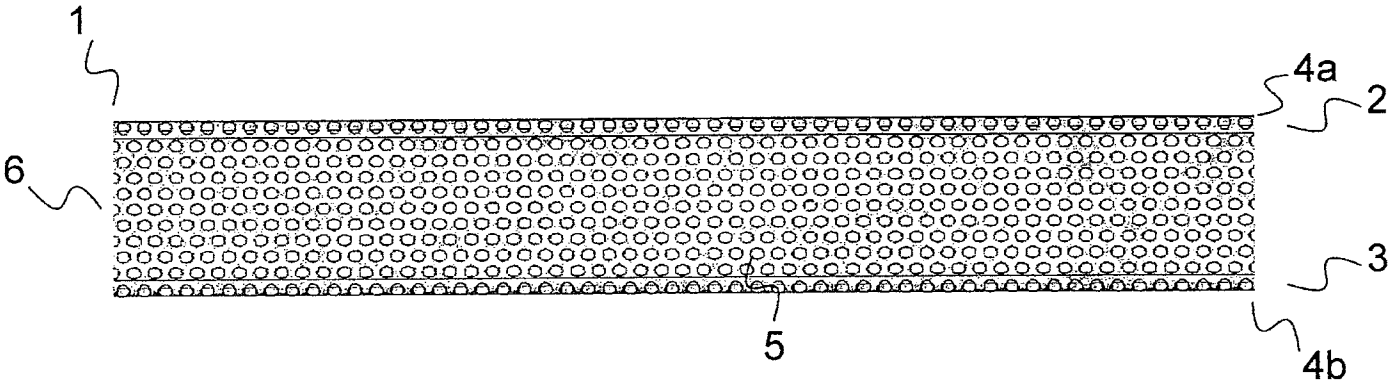
FIG. 1 serves to describe the invention in more detail below.
Figure 2A:
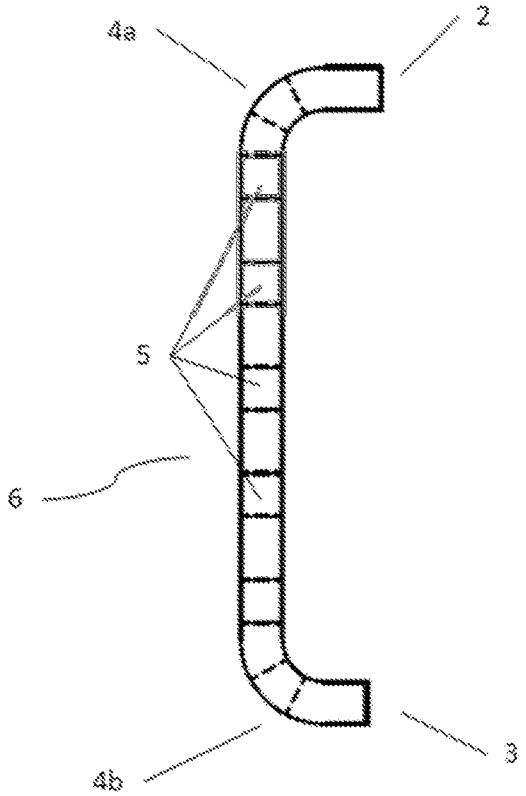
FIG. 2A shows: Side view of the lamellar element of FIG. 1.
Figure 2B:
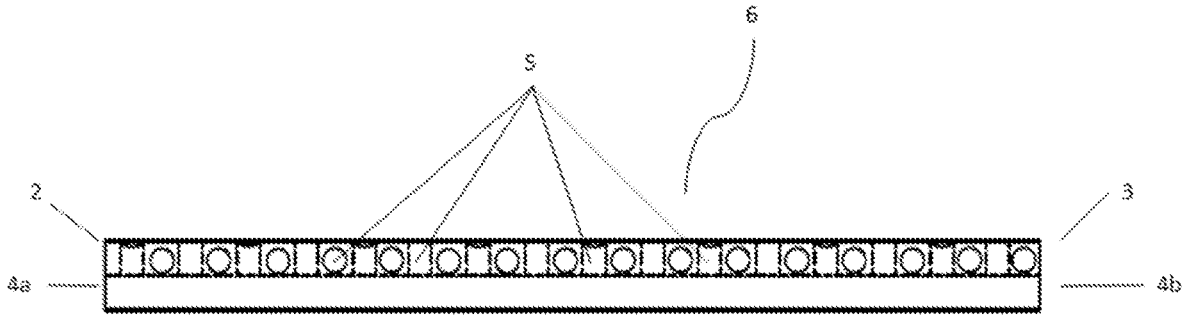
FIG. 2B show: Front view of the lamellar element of FIG. 1.

FIG. 1 shows a lamellar element 1 in flat C profile design. Flanks 2 and 3 which are bent to the rear are kept very short in relation to flat belly section 6, which is many times wider. Between flanks 2 and 3 and belly section 6, there are transitional sections 4*a* and 4*b*. In the flat belly section 6, lamellar element 1 is provided with holes 5 lined up in rows, the rows of holes being arranged parallel to each other and the holes being arranged diagonally from one row of holes to the next. This is the most efficient way to utilize the available surface area of belly section 8 for electrolysis. Advantageously there is a further row of holes in the transitional sections 4*a* or 4*b* and/or further additional rows of holes in the flanks 2 and 3 themselves. An essential advantage of this design is the plane-parallel arrangement of belly section 6 to the membrane upon installation, where the electrochemical reaction can take place. In so doing, the membrane is supplied with caustic or brine through holes 5.

In addition, the cell voltage of an electrolysis cell using an electrode which consists of lamellar elements of C profile design according to the present invention was determined. In comparison to this, the cell voltage of an electrolysis cell using an electrode of C profile design as disclosed by DE 102005006555 A1 was determined, the electrode being different in so far as the holes provided are arranged in grooves and the surface area of the lamellar elements is thus characterized by constructional elevations and depressions. In addition, the holes of the flat belly section are not arranged diagonally to one another. Hence the designs of the two C profiles used differ only in the surface quality. Both C profiles used in the experiment had 11×62 holes which, in the case of the design according to the invention, were arranged in rows of holes arranged diagonally to one another. The hole diameter was 1.5 mm and the height of the C profile was 23 mm.

The description of the invention according to DE 10 2005 006 555 A1 emphasizes the advantageous effect of the grooves explained by the fact that the section with the highest current density, i.e. the contact area, is on the one hand supplied with educt in an ideal manner via the grooves by the continued stream of fluid from below, and on the other hand the product gas obtained and of a multiple greater volume is conveyed upwards via the grooves or via the holes to the rear side of the electrolysis electrode. On account of this, the person skilled in the art would, at first glance, not strive for any constructional modification of the lamellar elements.

Surprisingly, the comparative experiment yielded a significant decrease in voltage of approx. 60 mV (standardized to 90° C., 32% by wt. NaOH and 6 kA/$m^2$) if the groove structure of the lamellar elements is dispensed with and the holes are arranged diagonally to one another. This is attributed to a gas stagnation inside the grooves, which was not considered by DE 10 2005 006 555 A1.

Advantages created by the invention:

- Simplified construction of the lamellar elements of the electrode
- Significant decrease in voltage as compared to prior-art design types
- Even current distribution ensured across the membrane
- Elimination of problem of gas stagnation in grooves
- Cost-efficient method as a result of the significant decrease in cell voltage.

List of Reference Numbers and Designations

1 Lamellar elements
2 Upper flank
3 Lower flank
4*a, b* Bent transitional section
5 Holes
6 Belly section While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A membrane electrode assembly of an electrolysis cell for gas-producing electrochemical processes comprising:

a membrane;

an electrode comprising a plurality of lamellar elements, each lamellar element having a design of a flat C profile, the flat C profile having a flat belly section with a planar surface area without constructional elevations and depressions, two flank parts extending equidistant from the flat belly section and two transitional sections arranged between the flat belly section and the two flank parts to form the flat C profile, the flat belly section having a plurality of perforations throughout the entire flat belly section lined up in rows of holes, the rows of holes arranged parallel to each other, the holes arranged diagonally from one row of holes to the next row of holes, the two flank parts and two transitional sections having a plurality of perforations throughout the entire flank parts and transitional sections; and wherein the flat belly section of each of the plurality of lamellar elements of the electrode is in direct contact with the membrane and a spacing between each of the plurality of lamellar elements between 0 to 5 mm.

2. The membrane electrode assembly according to claim 1, wherein the perforations are round and the sheet thickness of the lamellar elements is smaller than the diameter of the perforations.

3. The membrane electrode assembly according to claim 1, wherein the spacing between each of the plurality of lamellar elements between 0 to 2 mm.

4. The membrane electrode assembly according to claim 3, wherein the spacing between each of the plurality of lamellar elements is 0 mm.

5. The electrode according to claim 1, wherein the two flank parts are inclined at an angle of at least 10 degrees with respect to the flat belly section of each of the lamellar elements.

6. The electrode according to claim 1, wherein the two transitional sections are formed as chamfered edges.

* * * * *